US005830291A

United States Patent [19]

McGuire et al.

[11] Patent Number: 5,830,291

[45] Date of Patent: Nov. 3, 1998

[54] METHOD FOR PRODUCING BRIGHT STAINLESS STEEL

[75] Inventors: Michael F. McGuire, Pittsburgh, Pa.; Kelley L. Senzarin-Kulik, Uniontown; Anthony J. Denoi, North Canton, both of Ohio

[73] Assignee: J&L Specialty Steel, Inc., Pittsburgh, Pa.

[21] Appl. No.: 726,841

[22] Filed: Oct. 8, 1996

Related U.S. Application Data

[60] Provisional application No. 60/015,847 Apr. 19, 1996.

[51] Int. Cl.[6] ..... C21D 8/00

[52] U.S. Cl. ..... 148/610; 148/606

[58] Field of Search ..... 148/610, 606

[56] References Cited

U.S. PATENT DOCUMENTS

| | | | |
|---|---|---|---|
| 1,810,612 | 6/1931 | Kathner . | |
| 1,859,698 | 5/1932 | George . | |
| 1,901,039 | 3/1933 | Owens et al. . | |
| 1,931,134 | 10/1933 | Kinzel | 148/16 |
| 2,249,556 | 7/1941 | Fackert | 148/16 |
| 2,264,859 | 12/1941 | Ruder | 148/12 |
| 2,303,343 | 12/1942 | Engel et al. | 148/12 |
| 2,340,461 | 2/1944 | Gage et al. | 148/12 |
| 2,389,838 | 11/1945 | Bromberg | 148/16 |
| 2,474,674 | 6/1949 | Holden | 148/15 |
| 2,666,003 | 1/1954 | Dougherty et al. | 148/12 |
| 2,710,271 | 6/1955 | Fernsler et al. | 148/13.1 |
| 2,750,301 | 6/1956 | Wenderott | 117/50 |
| 2,752,274 | 6/1956 | Fox et al. | 148/13.1 |
| 2,987,429 | 6/1961 | Smith | 148/12 |
| 3,117,897 | 1/1964 | Williams | 148/142 |
| 3,260,619 | 7/1966 | Shoemaker et al. | 134/3 |
| 3,536,601 | 10/1970 | Hill et al. | 204/147 |
| 3,563,074 | 2/1971 | Avallone | 72/39 |
| 3,615,909 | 10/1971 | Hagen et al. | 148/16.7 |
| 3,712,833 | 1/1973 | Fichaux | 134/1 |
| 4,160,677 | 7/1979 | Lukac et al. | 134/9 |
| 4,286,986 | 9/1981 | Borneman | 75/126 F |
| 4,415,415 | 11/1983 | Zaremski | 204/141.5 |
| 4,450,058 | 5/1984 | Lovejoy | 204/145 R |
| 4,545,826 | 10/1985 | McCunn et al. | 148/12 E |
| 4,620,884 | 11/1986 | Heath | 148/128 |
| 4,648,914 | 3/1987 | Stanescu et al. | 148/16 |
| 4,713,154 | 12/1987 | Ohta et al. | 204/145 R |
| 4,851,092 | 7/1989 | Maresch | 204/145 R |
| 5,344,509 | 9/1994 | Zylla | 148/601 |
| 5,505,786 | 4/1996 | Cole et al. | 134/2 |

FOREIGN PATENT DOCUMENTS

| | | | |
|---|---|---|---|
| 62-253732 | 11/1987 | Japan | 148/610 |

*Primary Examiner*—Deborah Yee

*Attorney, Agent, or Firm*—Webb Ziesenheim Bruening Logsdon Orkin & Hanson, P.C.

[57] ABSTRACT

A method for producing bright stainless steel whereby a hot mill band having a dull oxide-free surface is first formed. The hot mill band is cold reduced to form a full hard coil having a shiny surface. The coil is subjected to continuous annealing at a temperature of 1500°–1950° F. in an oxygen-containing atmosphere sufficient to form a protective $FeCr_2O_3$ scale. The annealed coil is subjected to a mild non-etching pickling process to remove the black scale. The coil is then rolled on a temper mill having specially finished rolls to impart a surface pattern that replicates an abrasively polished surface.

18 Claims, 7 Drawing Sheets

METHOD FOR PRODUCING BRIGHT STAINLESS STEEL

CROSS REFERENCE TO RELATED APPLICATION

This application claims the benefit of earlier-filed U.S. Provisional patent application Ser. No. 60/015,847, filed Apr. 19, 1996.

BACKGROUND OF THE INVENTION

This invention relates to a process for producing stainless steels having a reproducible bright surface. More particularly, it relates to producing ferritic and austenitic stainless steels having a bright annealed-like surface but without the use of a protective atmosphere.

A significant portion of the flat rolled stainless steel sheet used in the world has a polished surface. This surface finish is generally produced by abrading the surface to produce a sanded appearance. A much smaller percentage is produced by embossing a similar pattern on stainless steel which has been annealed in a protective atmosphere. The embossed surface is generally the visual equivalent of the polished surface.

However, abrasive finishing is costly and time-consuming and may produce an inconsistent product in that it is prone to defects, such as polishing chatter, pits, minute surface tears, abrasive belt marks and the like. While embossed finishes are less costly to produce and are extremely uniform, the equipment to produce such finishes is scarce and an expensive bright annealed strip is required as the starting material. By bright annealed, we mean a strip that has been continuously annealed in a protective atmosphere, such as hydrogen and/or hydrogen/nitrogen so as to preclude the formation of surface oxides (in the first instance).

Austenitic stainless steels are typically annealed at temperatures on the order of 1900° to 2100° F. At these temperatures, air annealing produces thick scale, which scale cannot be economically removed by the milder acids necessary to minimize differential attack on the metal once the scale is dissolved. In the case of ferritic stainless steels, the annealing temperature is subcritical, normally below 1600° F. However, when carried out in an air atmosphere, there is a tendency to deplete the surface of the stainless steel of chromium leading to inferior corrosion resistance.

One such proposed solution is that found in U.S. Pat. No. 4,450,058. This patent recognizes the desirability of using an air anneal to avoid the capital cost associated with a controlled furnace atmosphere facility. However, after air annealing at conventional temperatures, the patentee removes scale by making the strip an anode and applying a direct electric current to the strip in an acidic electrolyte. The use of direct current is not practical in most existing facilities and at the temperatures in which the examples are annealed; namely, 1500° F. and 1750° F., chromium depletion is believed to be a significant problem.

It is therefore an object of the current invention to obtain a reproducible bright surface, such as a high gloss shiny surface, without the need for a protective atmosphere anneal.

There is a further objective to emboss a pattern which replicates an abrasively polished surface on said bright surface to avoid brushing and sanding and yet still obtain a desired surface quality.

These objectives must be consistent with the need to maintain the desired mechanical properties, e.g., yield strength.

SUMMARY OF THE INVENTION

Our invention derives from the unexpected observation that austenitic and ferritic stainless steels annealed below 1950° F. have a scale which is thin yet can be removed by oxidizing the scale in molten salt and then dissolving the scale in sulfuric acid and nitric acid. This leaves the base metal bright and relatively unattacked. Any scale formation on stainless steel partially depletes a thin layer near the surface of some chromium. A thin scale, however, contains a correspondingly small volume of chromium so little depletion exists. Thus mild acids are sufficient to both remove the oxide and restore the corrosion resistance of the surface to its pre-annealed state by dissolving a small volume of the metal surface which has been partially depleted of chromium. The stronger halide acids, such as hydrofluoric acid, can be substantially reduced or eliminated from use in conjunction with the sulfuric and/or nitric acid baths. This minimizes the differential attack on the grain boundaries which causes the surface to become dull. We have found that the hydrofluoric acid content should be maintained at or below 0.5% by weight.

This is unexpected because ferritic steels, which can be and usually are annealed at very low temperatures, e.g., 1600° F. have thin scales, but show heavy chromium depletion which requires strong pickling. This makes polishing essential in the final product to arrive at a bright and shiny surface. By annealing at a higher temperature, we theorize the diffusion rate of chromium is sufficiently high to eliminate, by diffusion, the chromium concentration gradient, and permit a mild pickling without excessive chromium depletion.

Likewise on austenitic stainless steels, which are ordinarily annealed at high temperatures of about 2000° F., we theorized that lower temperature annealing minimizes scale growth and the corresponding chromium depletion. In each case the result is a thin scale, with minimum oxidation attack to the underlying metal and minimal distortion of the subsurface chromium concentration. These thin scales are then amenable to dissolution by the milder acids which dissolve oxides (scale) but do not etch the underlying metal surface. Under certain operating conditions scales are formed which are effective barriers to oxygen diffusion and thus to rapid scale growth. Slow scale growth is crucial to forming thin scale. Thin scale thus is favored by certain lower temperatures and higher oxygen partial pressures. Under normal conditions the partial pressure of oxygen should be on the order of 2% or greater although stable thin oxides can be obtained with partial pressures of oxygen as low as 0.1%. The fuel to air ratio to achieve the desired oxygen partial pressure varies with the humidity of the combustion air. Reference is to the percent of oxygen in the atmosphere. The use of an embossed surface instead of a polished surface not only eliminates the extra and costly processing but eliminates grinding defects including the microscopic defects which can carry through to the final product. This has led to improved stain removal on hard to remove stains such as permanent ink.

DETAILED DESCRIPTION OF THE PREFERRED EMBODIMENTS

Figure 1:
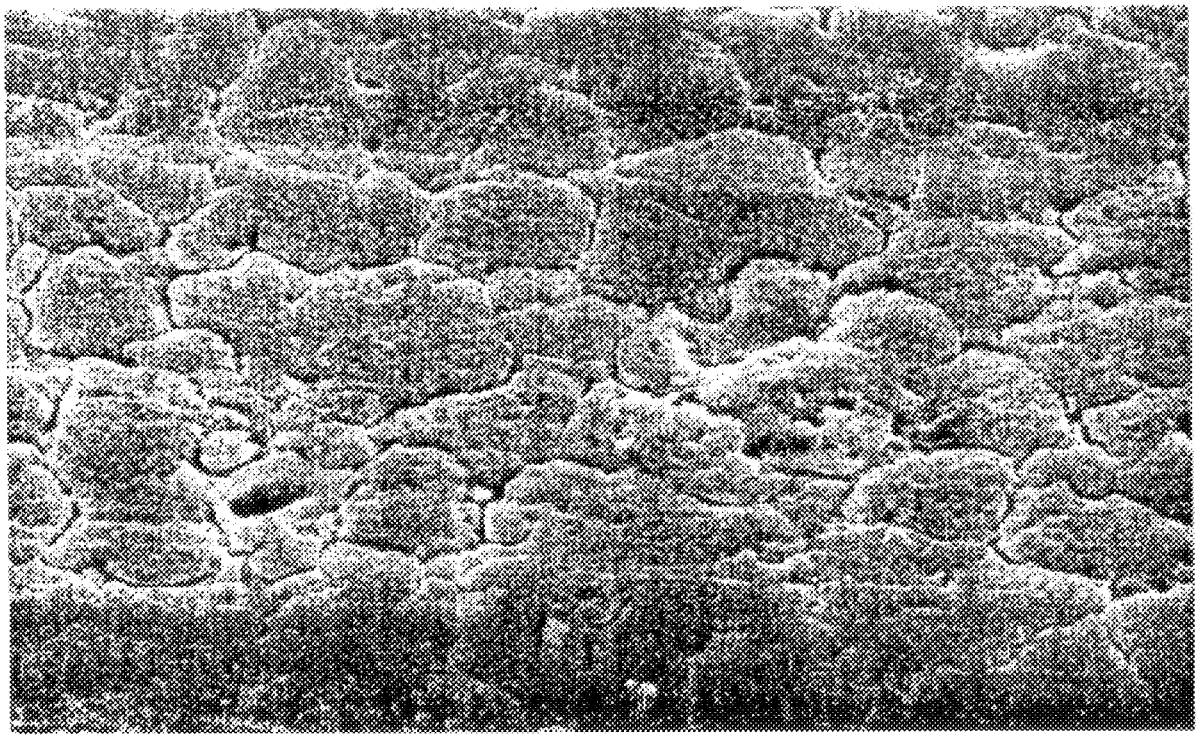
FIG. 1 is a photomicrograph at 4520x of a 304 stainless steel with a conventional anneal above 1950° F. and conventional pickling.

Conventional processing of the stainless steel is carried out through cold reduction. Exemplary of this processing is the melting of the appropriate scrap along with the necessary alloys, such as nickel and ferrochromium, to create a liquid steel melt. The melt is then transferred to a refining unit such as an argon oxygen decarburization (AOD) unit. The AOD process reduces the carbon levels in the steel and improves the steel's cleanliness and metallurgical consistency.

Following the refining process, the liquid steel is cast into appropriate thickness slabs on the order of 6 to 7½ inches on a continuous slab caster. The slab is then reheated in an appropriate reheat furnace and rolled on a conventional hot strip mill to thicknesses typically 0.10 inch to 0.25 inch. At this point in the process, the coil is referred to as a black band since it is covered with a dark colored oxide scale resulting from the hot rolling.

The black band is then hot annealed and pickled. The hot anneal for the austenitic stainless steel is normally carried out on the order of 2000° F. for the appropriate solution anneal. For ferritic stainless steels, a subcritical anneal to desensitize the product is carried out at 1600° F. (i.e., render the chromium composition uniform and homogeneous). Shot blasting may be used as part of the scale cleaning process in conjunction with the pickling.

At this time, a dull oxide free surface coil is metallurgically soft and ready for cold rolling. Cold rolling is normally carried out on a multi-roll Sendzimir mill, a multi-stand tandem mill or a 4-high reversing mill. The product off the cold mill is considered full hard and at final gauge with a mirror-like surface. Product thickness is normally on the order of 0.015 inch to 0.187 inch. Reductions from the hot band to the cold band are on the order of 30–85%. The coil can normally not be used in this condition and must be softened by annealing.

In the case of austenitic stainless steels, such as AISI 304, the full hard coil is subjected to an anneal in a standard air atmosphere continuous anneal using a partial pressure of oxygen of at least 2% and at a temperature of 1800° to 1950° F. Leaving the continuous anneal furnace, the strip has a black scale on the order of 3000 angstroms thick. At the conventional higher annealing temperatures for austenitic stainless steels, the scale would have had a thickness on the order of 10,000 angstroms. The strip is air cooled out of the continuous anneal to approximately 1000° F. where it is subjected to a molten salt treatment which has the effect of enriching the oxygen content of the scale so as to make the scale more soluble. The strip is then air cooled and fed into a series of pickle tanks which subject the strip to sulfuric acid, a water rinse, nitric acid, a water rinse and finally a repeat of the nitric acid and water rinse cycle. It is not necessary to use the typical stronger acid, such as hydrofluoric acid at conventional concentrations which etches and causes a matte or dull type surface. Where hydrofluoric acid is used, it can be used in concentrations of 0.5% and less by weight. We have also found that by maintaining the iron content of the nitric acid tanks at or below 1% we are able to achieve the desired uniformity and level of brightness of the steel surface.

There are other known pickling techniques including electrolytic pickling using a salt bath and alternating current which can be utilized and which do not attack the base metal.

The surface of a conventionally processed 304 stainless steel annealed above 1950° F. and then pickled in a pickling process which include a conventional hydrofluoric acid bath is shown in FIG. 1. The grain boundaries are attacked more than the grains and the surface has a "ditched" grain boundary appearance.

Figure 2:
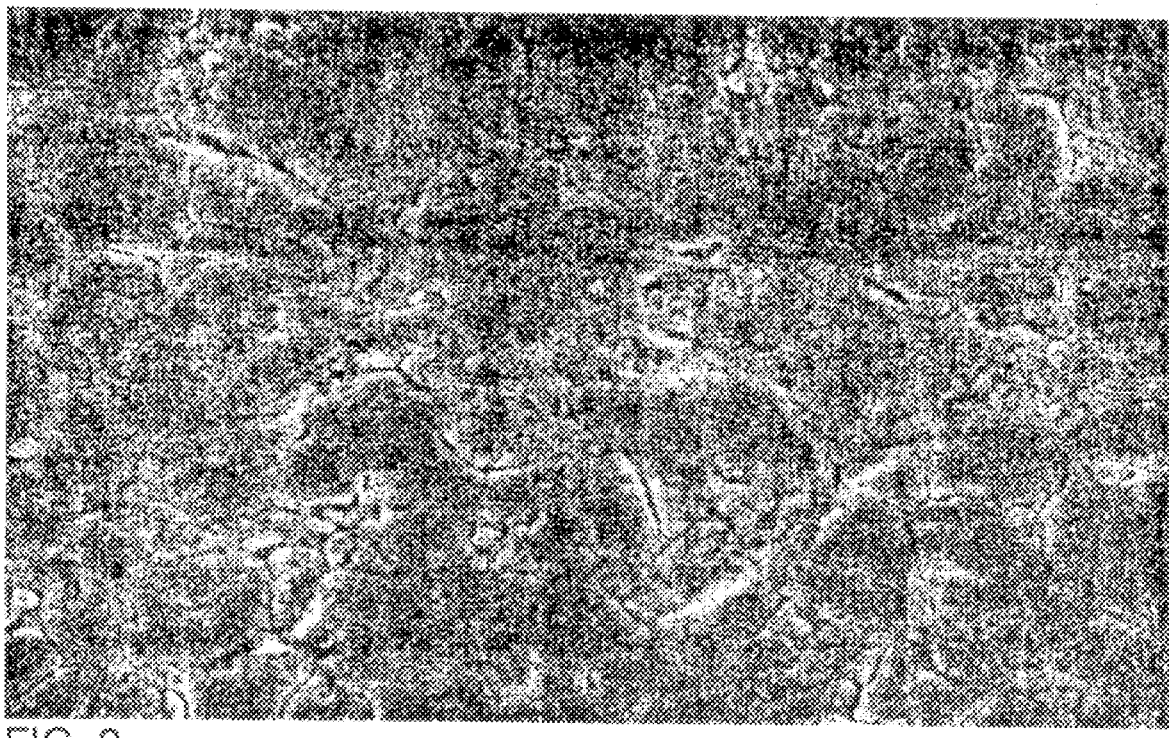
FIG. 2 is a photomicrograph at 4520x of a 304 stainless steel with an anneal below 1950° F. and bright pickling.

In contrast the same steel which has been annealed below 1950° F. and bright pickled with no hydrofluoric acid present shows grain boundaries which are far less etched and shows an even attack of the pickling acid on the grain and grain boundaries alike, see FIG. 2.

Figure 3:
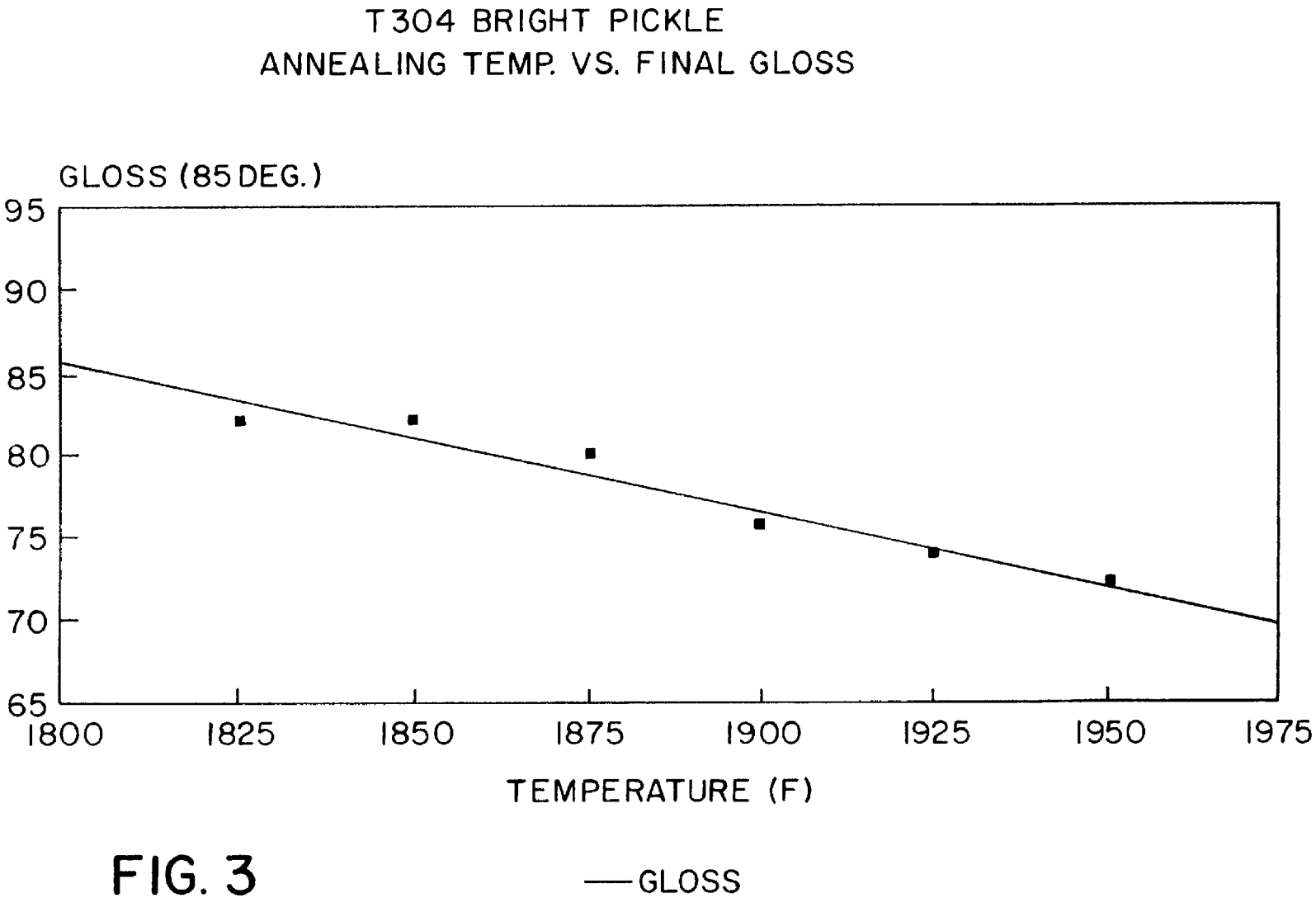
FIG. 3 is a graph of a 304 stainless steel bright pickled and plotting anneal temperatures versus gloss.
Figure 4:
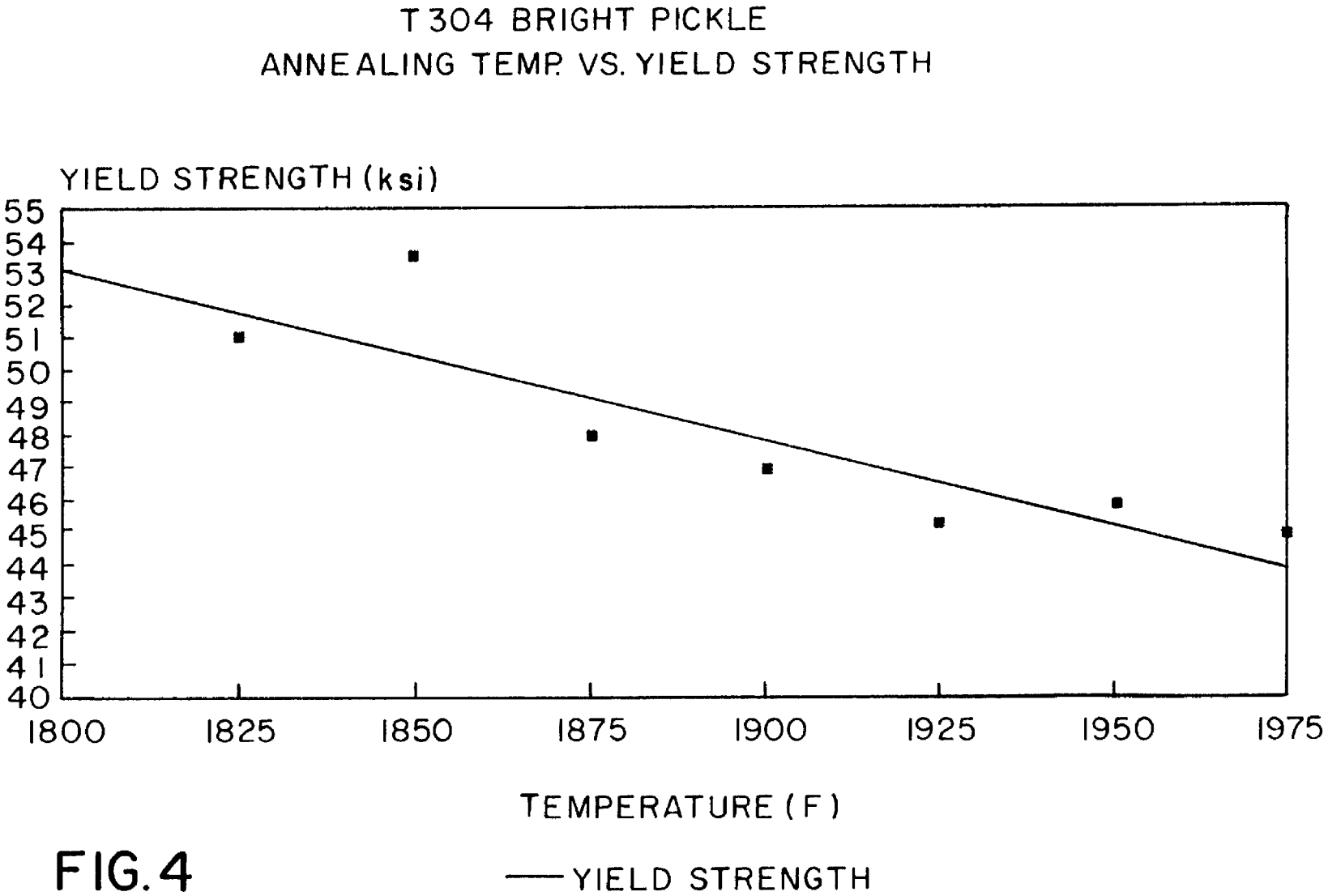
FIG. 4 is a graph of a 304 stainless steel bright pickled and plotting anneal temperatures versus yield strength.

As the annealing temperature decreases, the thickness of scale to be removed decreases and the surface gloss increases, see FIG. 3. However, at the same time, the yield strength increases with the decrease in annealing temperature, see FIG. 4. The annealing temperature range of 1800° F. to 1950° F. provides an optimum balance between surface gloss and yield strength.

Figure 6:
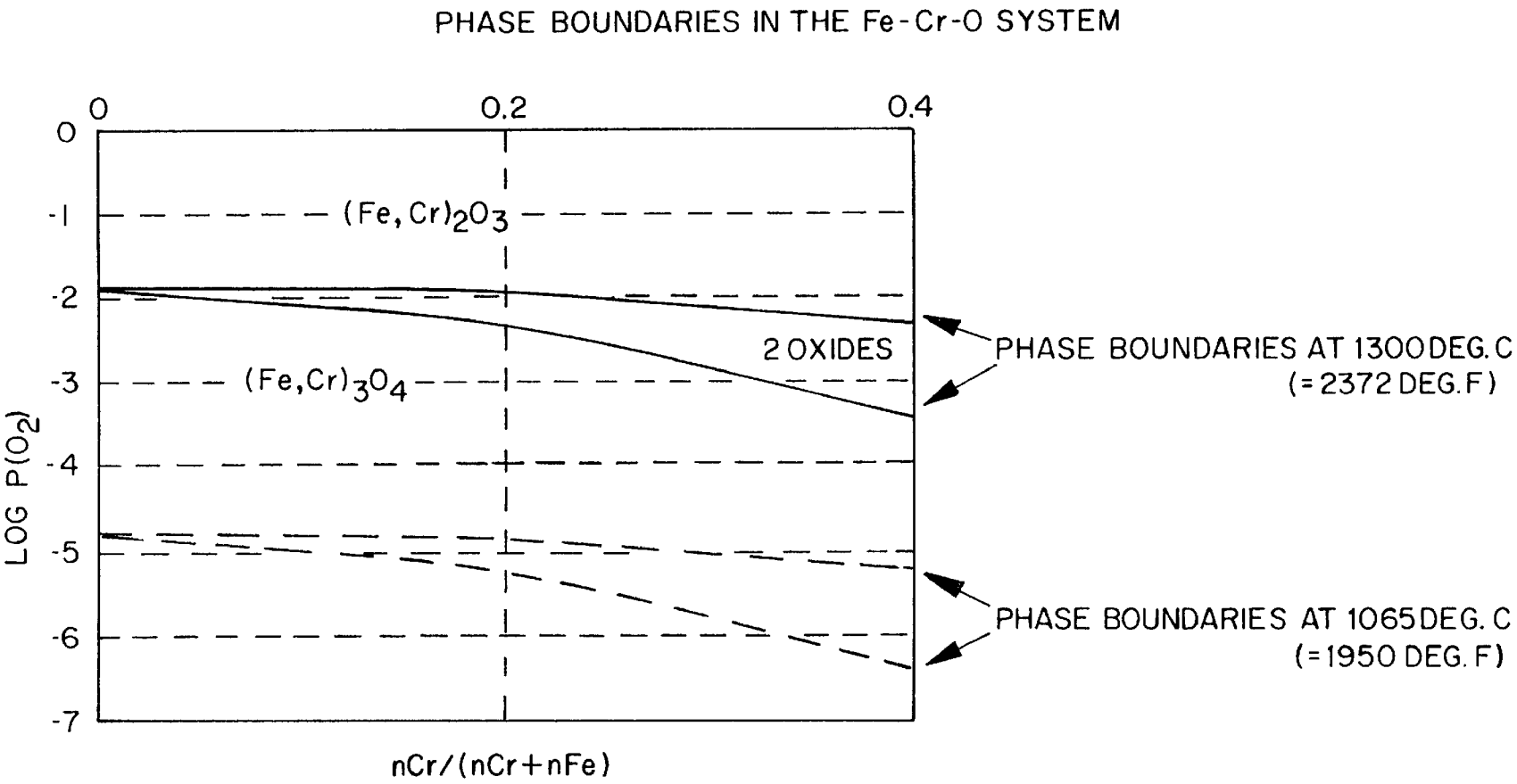
FIG. 6 is the phase boundary diagram for the Fe-Cr-O system at 2372° F. and 1950° F., respectively.
Figure 7:
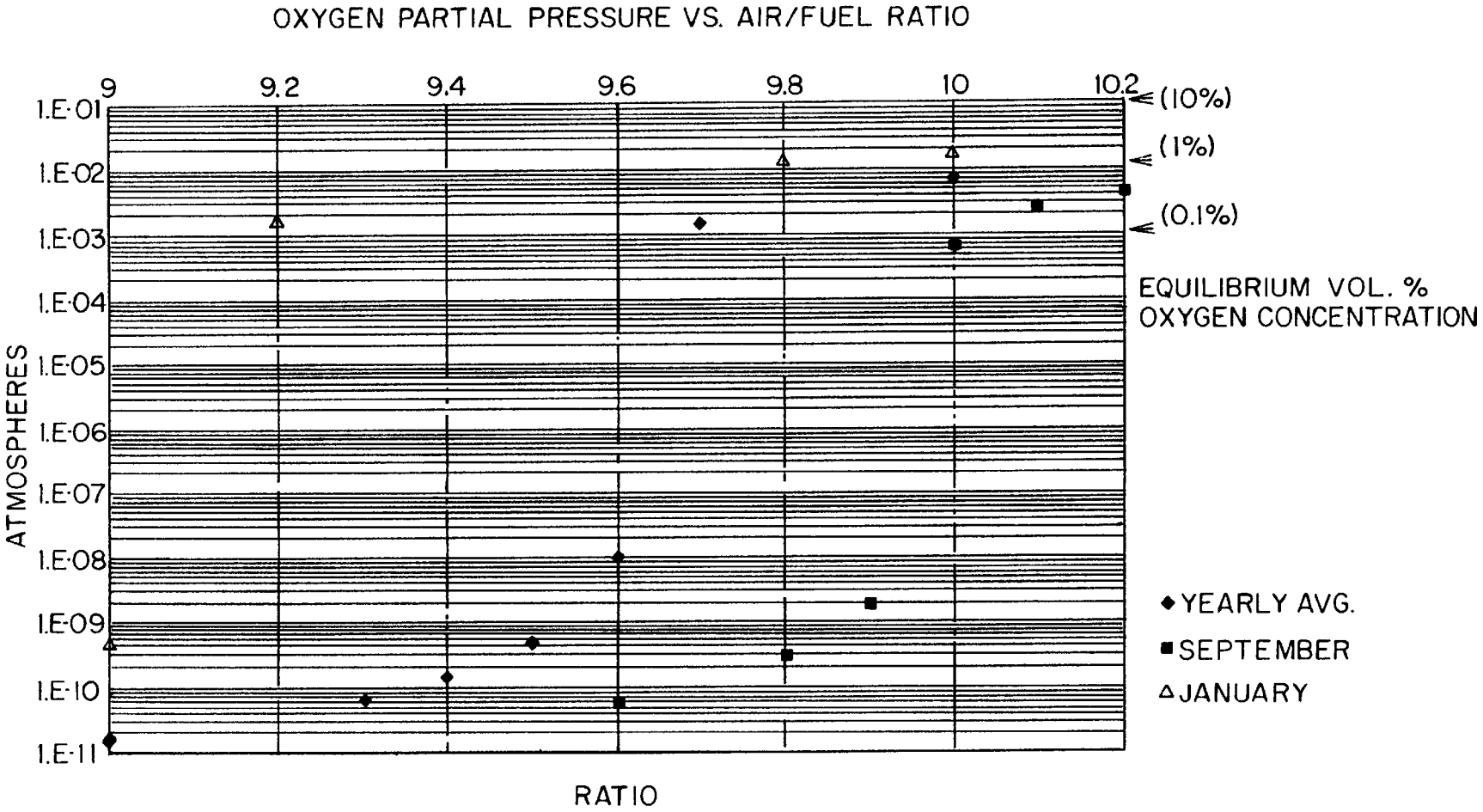
FIG. 7 is the oxygen partial pressure versus air/fuel ratio.

The annealing to provide the thin scale is determined not only by temperature but also by oxygen partial pressure. Only the $FeCr_2O_3$ type scale sufficiently limits oxygen diffusion to provide a sufficiently thin scale for a final bright surface. FIGS. 6 and 7 show the oxygen partial pressures at which the proper scale type forms and the air/fuel ratio which in practice provides it.

It is necessary to have sufficient oxygen to have a stable $FeCr_2O_3$ scale at normal humidity levels this will result from an oxygen partial pressure of 2% or greater. Low humidity regions may be able to achieve such a result at partial pressures as low as 0.1%.

In the case of ferritic stainless steels, a preferred form of the invention is to utilize a stabilized chemistry, such as a titanium containing AISI 439 grade. It is understood that various other ferrite stabilizers such as Nb, Ta and Zr may be used to stabilize these non-nickel bearing ferritic grades. These grades can be annealed at a higher temperature of 1700° to 1950° F. At such a temperature, the scale is still thin and chromium depletion is avoided. In addition, mild pickling may be used without the need for conventional hydrofluoric acid concentrations or other complex electrolytic processes. On unstabilized ferritic grades, the annealing temperature should be kept low enough to avoid sensitization and the chromium content kept at the high end of the range to assure a corrosion resistant bright surface. On unstabilized grades, it may be necessary to anneal at temperatures as low as 1500° F. to obtain optimum properties.

The product can now go into the finishing operations, which are now further simplified. Because of the bright surface, a specially finished roll can be used to produce a pattern that replicates an abrasively polished surface. This specially finished roll pass can be preceded by a temper pass using smooth rolls. Such a surface would typically be defined by an arithmetic roughness (Ra) of 2 to 50 micro inch and an 85° transverse surface gloss of 40 to 90%. There surface measurements are in accordance with ASTM specification D 523-89. Specific gloss and surface appearance can be further controlled by known temper pass techniques.

The following Table I shows a summary of surface gloss and yield strength for a Type 430 stabilized ferritic stainless steel processed in accordance with the subject invention. Both the surface gloss and yield strength are acceptable.

TABLE I

GLOSS VS. YIELD FOR A STABILIZED 430 STAINLESS STEEL

| Coil | 85° Transverse Surface Gloss | Yield (KSI) |
|---|---|---|
| W647580 | 66 | 50.2 |
| W600168 | 41 | 42.4 |
| W687369 | 55 | 46.2 |
| W687368 | 48 | 48.4 |
| W687366 | 50 | 51.3 |
| W687365 | 50 | 50.4 |
| W687367 | 57 | 49.8 |
| W671068 | 70 | 45 |
| W681817 | 72 | 52.1 |
| W695017 | 76 | 47.2 |
| W695020 | 65 | 47.9 |
| W695024 | 68 | 48.9 |
| W681822 | 64 | 55.6 |

It is recognized that the scale thickness is crucial to our process. Therefore, known factors, such as composition, excess oxygen in the furnace and annealing time can be adjusted to further minimize scale formation and contribute to the final surface quality.

Likewise, factors which enhance recrystallization such as percent cold reduction can also be utilized to decrease exposure to scale formation.

We are thus able to achieve a reproducible bright surface on conventional air continuous anneal lines without the need for protective atmospheres and without the need for expensive polishing operations.

The elimination of grinding also produces a product having improved cleaning for certain staining agents such as black ink. It is believed that this improvement comes about because of the lesser surface tears associated with an embossed temper pass over conventional grinding.

Figure 5A:
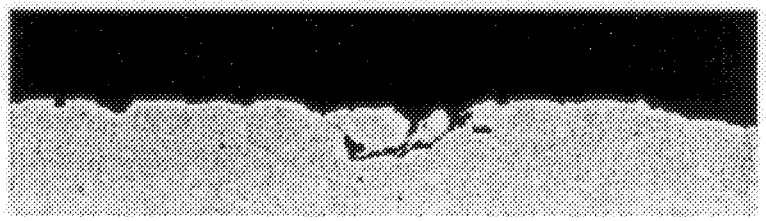
FIGS. 5A–5D are optical microscopy images at 1000x showing the surface of a conventional processed stainless steel which has been polished.
Figure 5B:
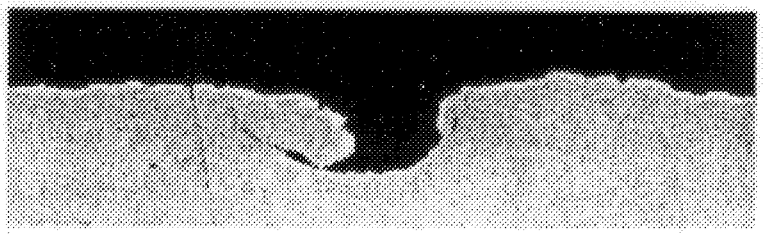
Figure 5C:
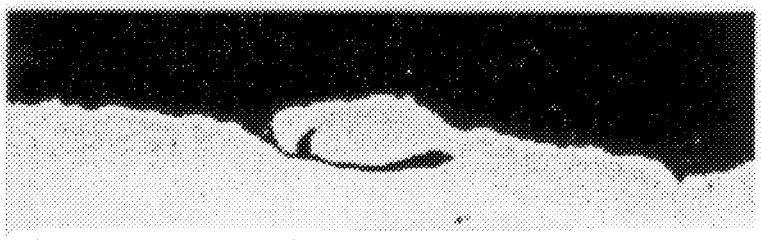
Figure 5D:
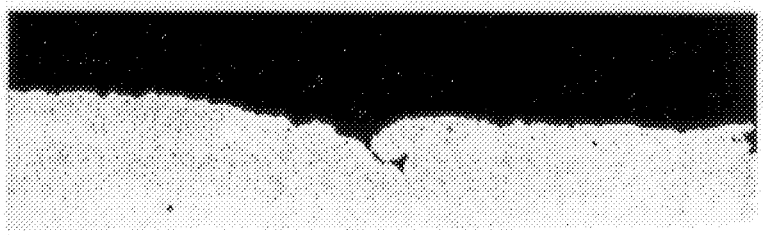
Figure 5E:
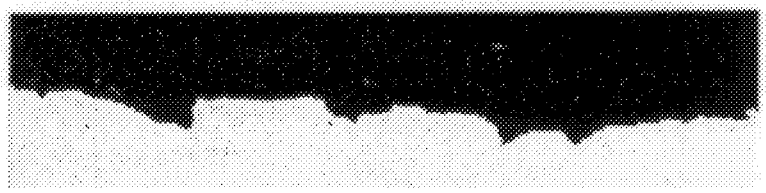
FIG. 5E is an optical microscopy image at 1000x showing the surface of the subject invention.

Typical microscopically shown surface crevices caused by surface grinding are illustrated in FIGS. 5A–5D. The same steel made in accordance with the subject invention including an embossed temper pass in lieu of mechanical polishing has far less surface tears and crevices as shown in FIG. 5E. This results in the improved ability to remove normally difficult to remove stains such as black ink.

The following tests reported in Table II were run by the National Sanitation Foundation using permanent black ink as the staining agent. Embossed steels made in accordance with the subject invention were compared with conventional steels receiving a #4 grinding polish.

TABLE II

PERMANENT BLACK INK STAINING AFTER PERIODS OF DRYING

| | | Stain After Drying | | | |
|---|---|---|---|---|---|
| SS Type | Finish | 1 Hr. | 4 Hr. | 24 Hr. | 72 Hr. |
| 430 | Embossed | very faint | faint | very faint | very faint |
| 430 | Embossed | barely visible | faint | faint | faint |
| 304T | Embossed | barely visible | barely visible | barely visible | barely visible |
| 201 | Embossed | none | none | none | none |

TABLE II-continued

PERMANENT BLACK INK STAINING AFTER PERIODS OF DRYING

| | | Stain After Drying | | | |
|---|---|---|---|---|---|
| SS Type | Finish | 1 Hr. | 4 Hr. | 24 Hr. | 72 Hr. |
| 430 | #4 Polish | dark | very dark | very dark | very dark |
| 304 | #4 Polish | very dark | very dark | very dark | very dark |

At all cleaning times and for all types of stainless steel tested, more of the black ink was removed from the steels of the present invention than the conventionally processed #4 polish finish.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

We claim:

1. A method for producing bright stainless steel comprising:

a) forming a hot mill band having a dull oxide free surface;

b) cold reducing the hot mill band to form a full hard coil having a shiny surface;

c) subjecting said full hard coil to a continuous anneal at a temperature of 1500°–1950° F. in an oxygen containing atmosphere sufficient to form a protective $FeCr_2O_3$ scale;

d) subjecting said annealed coil to a mild non-etching pickling process to remove the scale; and e) rolling said annealed coil on a temper mill having specially finished rolls configured to impart a surface pattern that replicates an abrasively polished surface.

2. The method of claim 1 wherein the mild non-etching pickling process includes air cooling the annealed coil to an intermediate temperature where it is subjected to a molten salt treatment and then air cooling to ambient temperature where the coil is subjected to a mild acid pickle.

3. The method of claim 2 wherein the intermediate temperature is between 800° F. and 1000° F.

4. A method for producing bright stainless steel comprising:

a) forming a hot mill band having a dull oxide free surface;

b) cold reducing the hot mill band to form a full hard coil having a shiny surface;

c) subjecting said full hard coil to a continuous anneal at a temperature of 1500°–1950° F. in an oxygen containing atmosphere sufficient to form a protective $FeCr_2O_3$ scale:

d) subjecting said annealed coil to a mild non-etching pickling process to remove the scale, wherein the mild non-etching pickling process includes air cooling the annealed coil to an intermediate temperature between 800° F. and 1000° F. where it is subjected to a molten salt treatment and then air cooling to ambient temperature where the coil is subjected to a mild acid pickle, and wherein the mild acid pickle includes subjecting said annealed coil to at least one of a nitric acid bath and rinse, a sulfuric acid bath and rinse with hydrofluoric concentration of 0.5% or less on either acid bath; and e) rolling said annealed coil on a temper mill having specially finished rolls configured to impart a surface pattern that replicates an abrasively polished surface.

5. The method of claim 3 including a mild acid bath and maintaining an iron content of the nitric acid bath at or below 1%.

6. The method of claim 1 wherein the surface pattern following temper rolling is defined by an arithmetic roughness on the order of 2 to 50 micro inch and an 85° transverse surface gloss of 40 to 90%.

7. The method of claim 1 wherein the stainless steel is of the austenitic type and the annealing temperature is 1800° to 1950° F.

8. The method of claim 1 wherein the stainless steel is of the ferritic type and the composition includes ferrite stabilizers.

9. The method of claim 8 wherein the ferrite stabilizers include at least Ti.

10. The method of claim 1 wherein the atmosphere has an oxygen partial pressure of at least 0.1%.

11. The method claim of 10 wherein the oxygen partial pressure is at least 2%.

12. The method of claim 1 wherein the air/fuel ratio used for combustion is at least 9.2 to 1.

13. The method of claim 1 wherein said coil is subject to a temper pass on a smooth roll prior to the specially finished roll pass.

14. A method for producing bright stainless steel from a cold reduced, full hard coil, comprising the steps of:

subjecting the full hard coil to a continuous anneal at a temperature of 1500°–1950° F. in an oxygen containing atmosphere to form an $FeCr_2O_3$ containing scale on the annealed coil;

pickling the annealed coil with a mild non-etching pickling process to remove the scale, wherein the pickling process includes treating the annealed coil with an acid bath including at least one of nitric and sulfuric acid, the acid bath having a hydrofluoric acid content of less than 0.5%; and rolling the descaled coil on a temper mill having specially finished rolls such that a surface pattern is imparted to the rolled coil which replicates an abrasively polished surface.

15. The method as claimed in claim 14, wherein the steel is an austenitic steel and the annealing temperature is 1800°–1950° F.

16. The method as claimed in claim 15, wherein the atmosphere has an oxygen partial pressure of at least two percent.

17. The method as claimed in claim 14, wherein the steel is ferritic steel having at least one ferrite stabilizer selected from the group consisting of Ti, Nb, Ta and Zr and the annealing temperature is 1700°–1950° F.

18. The method as claimed in claim 14, including:

cooling the annealed coil to an intermediate temperature;

subjecting the annealed coil to a molten salt treatment; and cooling the annealed coil to ambient temperature.

* * * * *

US005830291C1

(12) REEXAMINATION CERTIFICATE (4367th)

United States Patent

McGuire et al.

(10) Number: US 5,830,291 C1

(45) Certificate Issued: May 22, 2001

(54) METHOD FOR PRODUCING BRIGHT STAINLESS STEEL

(75) Inventors: Michael F. McGuire, Pittsburgh, PA (US); Kelley L. Senzarin-Kulik, Uniontown; Anthony J. Denoi, North Canton, both of OH (US)

(73) Assignee: J&L Specialty Steel, Inc., Pittsburgh, PA (US)

Reexamination Request:
No. 90/005,498, Sep. 16, 1999

Reexamination Certificate for:

| | |
|---|---|
| Patent No.: | **5,830,291** |
| Issued: | **Nov. 3, 1998** |
| Appl. No.: | **08/726,841** |
| Filed: | **Oct. 8, 1996** |

Related U.S. Application Data

(60) Provisional application No. 60/015,847, filed on Apr. 19, 1996.

(51) Int. Cl.[7] ..... C21D 8/00

(52) U.S. Cl. ..... 148/610; 148/606

(58) Field of Search ..... 148/610, 606

(56) References Cited

FOREIGN PATENT DOCUMENTS

| | | |
|---|---|---|
| 60-262922 | 12/1985 | (JP) . |
| 3-075317 | 3/1991 | (JP) . |
| 6-269809 | 9/1994 | (JP) . |
| 6-299249 | 10/1994 | (JP) . |
| 7-048628 | 2/1995 | (JP) . |

OTHER PUBLICATIONS

Article entitled "Annealing and Pickling Lines for Stainless Steels," by B. Bousquet and J. Castel, published in Nov. 1985, Rev. Metall. Cab. Inf. Tech., pp. 821–831.

Article entitled "Cleaning and Finishing of Stainless Steel," by Whitney Snyder, Lester Felton and George Stanley. American Society for Metals, 1976, pp. 358 and 377.

Article entitled "Stainless Steels," edited by P. Lacomb, Baroux and G. Beranger, published in 1993, pp. 834–840; 873–880.

Book entitled "Cold Rolling of Steel", William Roberts, 1978, pp. 739–741, 775.

*Primary Examiner*—Deborah Yee

(57) ABSTRACT

A method for producing bright stainless steel whereby a hot mill band having a dull oxide-free surface is first formed. The hot mill band is cold reduced to form a full hard coil having a shiny surface. The coil is subjected to continuous annealing at a temperature of 1500°–1950° F. in an oxygen-containing atmosphere sufficient to form a protective $FeCr_2O_3$ scale. The annealed coil is subjected to a mild non-etching pickling process to remove the black scale. The coil is then rolled on a temper mill having specially finished rolls to impart a surface pattern that replicates an abrasively polished surface.

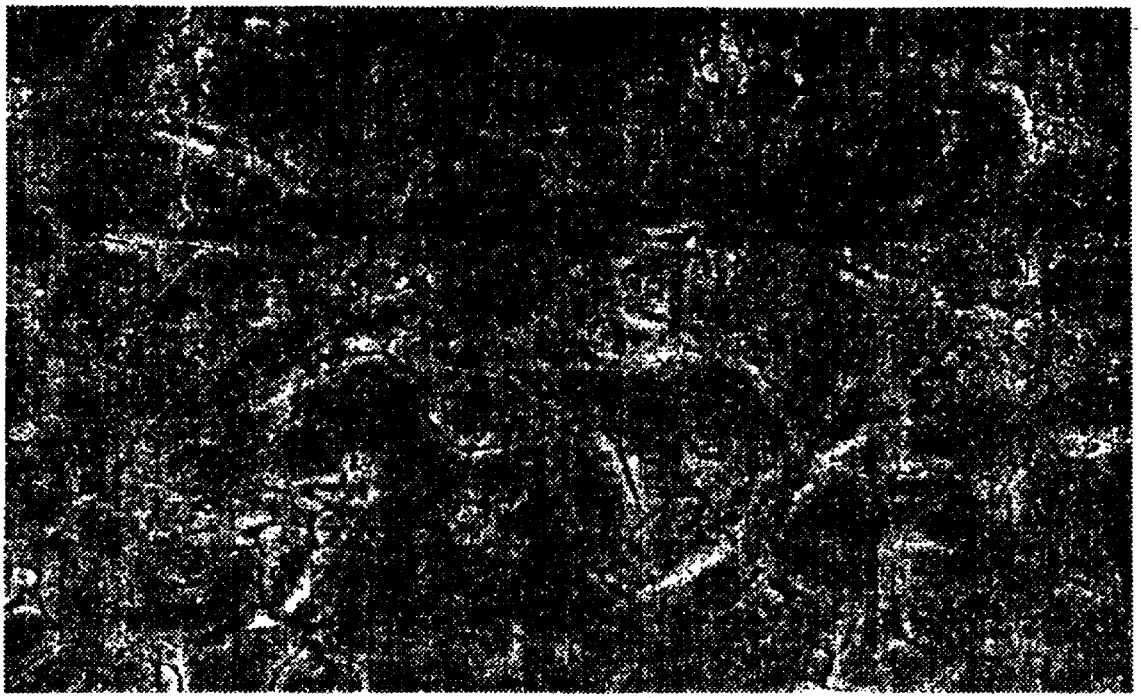

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4 and 14–18 is confirmed.

Claim 1 is determined to be patentable as amended.

Claims 2, 3, and 5–13, dependent on an amended claim, are determined to be patentable.

1. A method for producing bright stainless steel comprising:

a) forming a hot mill band having a dull oxide free surface;

b) cold reducing the hot mill band to form a full hard coil having a shiny surface;

c) subjecting said full hard coil to a continuous anneal at a temperature of 1500°–1950° F. in an oxygen containing atmosphere sufficient to form a protective $FeCr_2O_3$ scale;

d) subjecting said annealed coil to a mild non-etching pickling process *sufficient* to remove the [scale] *oxide and restore corrosion resistance with minimal differential attack on grain boundaries and grain surface thereby preventing the surface from becoming dull*; and e) rolling said annealed coil on a temper mill having specially finished rolls configured to impart a surface pattern that replicates an abrasively polished surface.

* * * * *